US010888909B2

(12) United States Patent
Palfreman et al.

(10) Patent No.: US 10,888,909 B2
(45) Date of Patent: Jan. 12, 2021

(54) ROLLING MILL POURING REEL

(71) Applicant: PRIMETALS TECHNOLOGIES USA LLC, Alpharetta, GA (US)

(72) Inventors: Matthew D. Palfreman, Charlton, MA (US); Paras H. Patel, Worcester, MA (US)

(73) Assignee: Primetals Technologies USA LLC, Alpharetta, GA (US)

( * ) Notice: Subject to any disclaimer, the term of this patent is extended or adjusted under 35 U.S.C. 154(b) by 286 days.

(21) Appl. No.: 16/061,545

(22) PCT Filed: Dec. 14, 2016

(86) PCT No.: PCT/US2016/066620
§ 371 (c)(1),
(2) Date: Jun. 12, 2018

(87) PCT Pub. No.: WO2017/123374
PCT Pub. Date: Jul. 20, 2017

(65) Prior Publication Data

US 2020/0261956 A1 Aug. 20, 2020

Related U.S. Application Data

(60) Provisional application No. 62/277,103, filed on Jan. 11, 2016.

(51) Int. Cl.
*B21C 47/04* (2006.01)
*B21C 47/28* (2006.01)

(52) U.S. Cl.
CPC ..... *B21C 47/04* (2013.01); *B21C 47/28* (2013.01)

(58) Field of Classification Search
CPC ..... B21C 47/04; B21C 47/28
(Continued)

(56) References Cited

U.S. PATENT DOCUMENTS 434,190 A * 8/1890 Matteson ..... B21C 47/14 242/362.3
3,618,871 A * 11/1971 Gilvar ..... B21C 47/14 242/363
(Continued)

FOREIGN PATENT DOCUMENTS

DE 2057899 5/1972
DE 2057899 A1 5/1972
(Continued)

OTHER PUBLICATIONS

International Search Report issued in related PCT Application No. PCT/US2016/066620 dated Mar. 22, 2017.
(Continued)

*Primary Examiner* — Michael E Gallon
(74) *Attorney, Agent, or Firm* — Gesrner Updegrove LLP

(57) ABSTRACT

A pouring reel for forming a hot rolled long product into an annular coil comprises a central mast lying on a vertical axis. A cylindrical tub surrounds and cooperates with the central mast to form an annular tub chamber. A coil plate defines a bottom of the tub chamber. The central mast, cylindrical tub and coil plate are rotatable in unison about the vertical axis. An entry nozzle has a delivery end arranged to direct the product downwardly into the tub chamber for accumulation on the coil plate as a series of superimposed rings forming the coil. The coil plate is movable downwardly along the vertical axis and relative to the central mast and the cylindrical tub to accommodate the increasing height of the coil being formed in the tub chamber.

11 Claims, 9 Drawing Sheets

(58) Field of Classification Search
USPC ... 242/361, 361.1, 361.4, 362, 362.1, 362.2, 242/303
See application file for complete search history.

(56) References Cited

U.S. PATENT DOCUMENTS

| | | | | |
|---|---|---|---|---|
| 3,955,773 | A * | 5/1976 | Blinn | B21C 47/14 242/362 |
| 5,823,456 | A * | 10/1998 | Bordignon | B21C 47/045 242/362 |
| 2007/0063088 | A1* | 3/2007 | Schlichter | B65H 67/0428 242/361.4 |
| 2009/0249852 | A1* | 10/2009 | Shore | B21C 47/28 72/66 |

FOREIGN PATENT DOCUMENTS

| | | | |
|---|---|---|---|
| JP | S5011960 | A | 2/1975 |
| JP | S50100464 | A | 8/1975 |
| JP | S5571862 | A | 5/1980 |
| JP | S6336917 | A | 2/1988 |
| JP | S63140725 | A | 6/1988 |
| JP | 2011516272 | A | 5/2011 |
| WO | 2009123685 | A3 | 10/2009 |

OTHER PUBLICATIONS

Office Action issued by the Japanese Patent Office dated Oct. 21, 2019 in related Japanese Patent Application No. 2018-536102.
Office Action issued by the European Patent Office dated Jan. 30, 2020 in related European Patent Application No. 16822335.2.

* cited by examiner

ROLLING MILL POURING REEL

PRIORITY INFORMATION

This application is a 371 of PCT Application No. PCT/US2016/066620 filed Dec. 14, 2016, which claims priority to provisional application Ser. No. 62/277,103 filed Jan. 11, 2016, the contents of which are incorporated herein by reference.

FIELD OF THE INVENTION

This invention relates generally to hot rolling mills producing bars and other like long products, and is concerned in particular with pouring reels employed to receive and form such products into cylindrical coils.

DESCRIPTION OF THE PRIOR ART

Current pouring reels operate as the name implies. A bar product is effectively poured or fed via a nozzle into a rotating tub having radially spaced inner and outer walls defining an annular chamber closed at its lower end by a fixed tub bottom. The tub runs at a synchronous velocity to that of the entering bar.

The nozzle is positioned such that when the bar enters the annular chamber, it contacts the outer tub wall at a tangent angle and then runs on the inner tub wall to form a spiral which accumulates as a cylindrical coil that starts at the tub bottom and forms itself vertically upward to fill the tub.

Such conventional pouring reels operate satisfactorily at bar delivery speeds up to and including about 16 m/sec. At higher speeds, however, the bar entering the tub is subjected to excessively high centripetal forces, which prevent the bar from feeding to the bottom of the tub as intended. The coil thus forms erratically and non-uniformly, with a lower than desired density. In extreme cases, the height of the low density coil is such that it spills out from the tub, creating both production problems and safety issues.

Also, in order to direct the product downwardly towards the tub bottom, the delivery nozzle is of necessity inclined at a relatively steep delivery angle, typically on the order of 50°. As a result, the tail end of the bar sticks up from the top of the coil at the same angle and must be pushed flat before the coil can be subjected to further processing.

SUMMARY OF THE INVENTION

Broadly stated, the objective of the present invention is to provide an improved pouring reel which avoids or at least substantially mitigates the above described problems.

In an exemplary embodiment of the present invention to be described hereinafter in greater detail, a pouring reel for forming a hot rolled long product into an annular coil comprises a central mast lying on a vertical axis. A cylindrical tub surrounds and cooperates with the central mast to form an annular tub chamber. A coil plate defines a bottom of the tub chamber. The central mast, cylindrical tub and coil plate are rotatable in unison about the vertical axis. An entry nozzle has a delivery end arranged to direct the product downwardly into the tub chamber for accumulation on the coil plate as a series of superimposed rings forming the coil. The coil plate is movable downwardly along the vertical axis and relative to the central mast and the cylindrical tub to accommodate the increasing height of the coil being formed in the tub chamber.

Vertically traversable conveying elements are circumferentially spaced around and extend vertically along the interior surface of the cylindrical tub. The conveying elements are traversed downwardly and synchronously with the descending coil plate. Preferably, this is achieved by coupling the conveying elements to the coil plate, although equivalent results may be achieved by separate drive mechanisms.

As herein employed, the term "conveying elements" is intended to be broadly construed to include various vertically extending and longitudinally traversable elements, including for example conveyor chains, conveyor belts, etc.

The conveying elements may comprise the inner runs of endless chains or belts arranged to extend between upper and lower idlers carried by the cylindrical tub.

The endless chains or belts may have outer return runs extending vertically along the exterior surface of the cylindrical tub.

The conveying elements may be received in and be traversable along guide channels in the interior surface of the cylindrical tub.

The conveying elements may project radially inwardly from the interior surface of the cylindrical tub.

Downward movement of the coil plate may also serve to maintain a substantially constant distance between the delivery end of the nozzle and the top of the coil being formed in the tub chamber.

The entry nozzle may be arranged at an angle of between 25° and 35°, and preferably at an angle of 30°, with respect to the horizontal.

These and other features and attendant advantages of the present invention will now be described in further detail with reference to the accompanying drawings.

DETAILED DESCRIPTION

Figure 1:
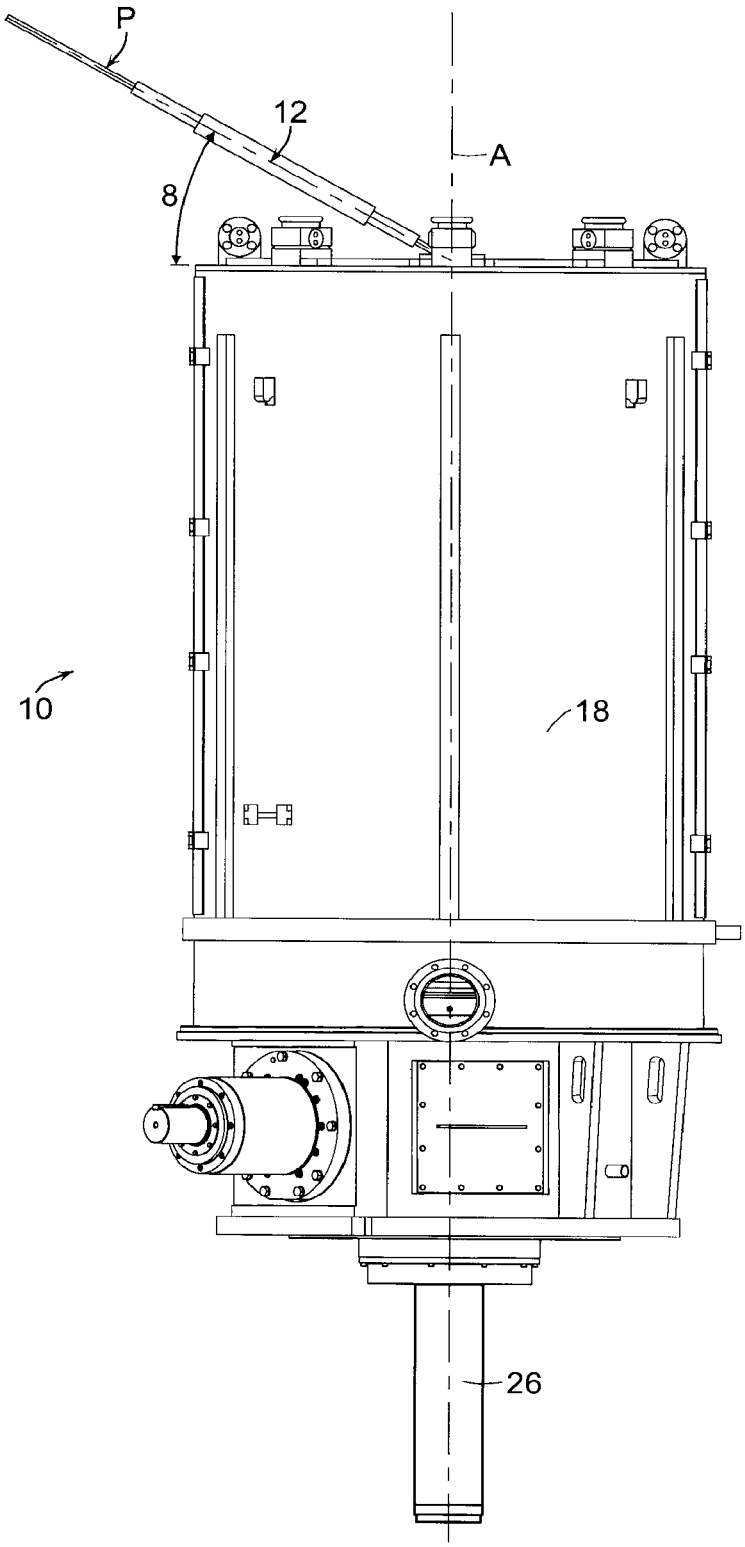
FIG. 1 is a side view of a pouring reel in accordance with an exemplary embodiment of the present invention.

An exemplary embodiment of a pouring reel in accordance with the present invention is generally depicted at 10 in FIG. 1. A nozzle 12 or other like delivery device serves to direct a hot rolled product "P" into the pouring reel where it is accumulated in the form of an annular coil.

Figure 2:
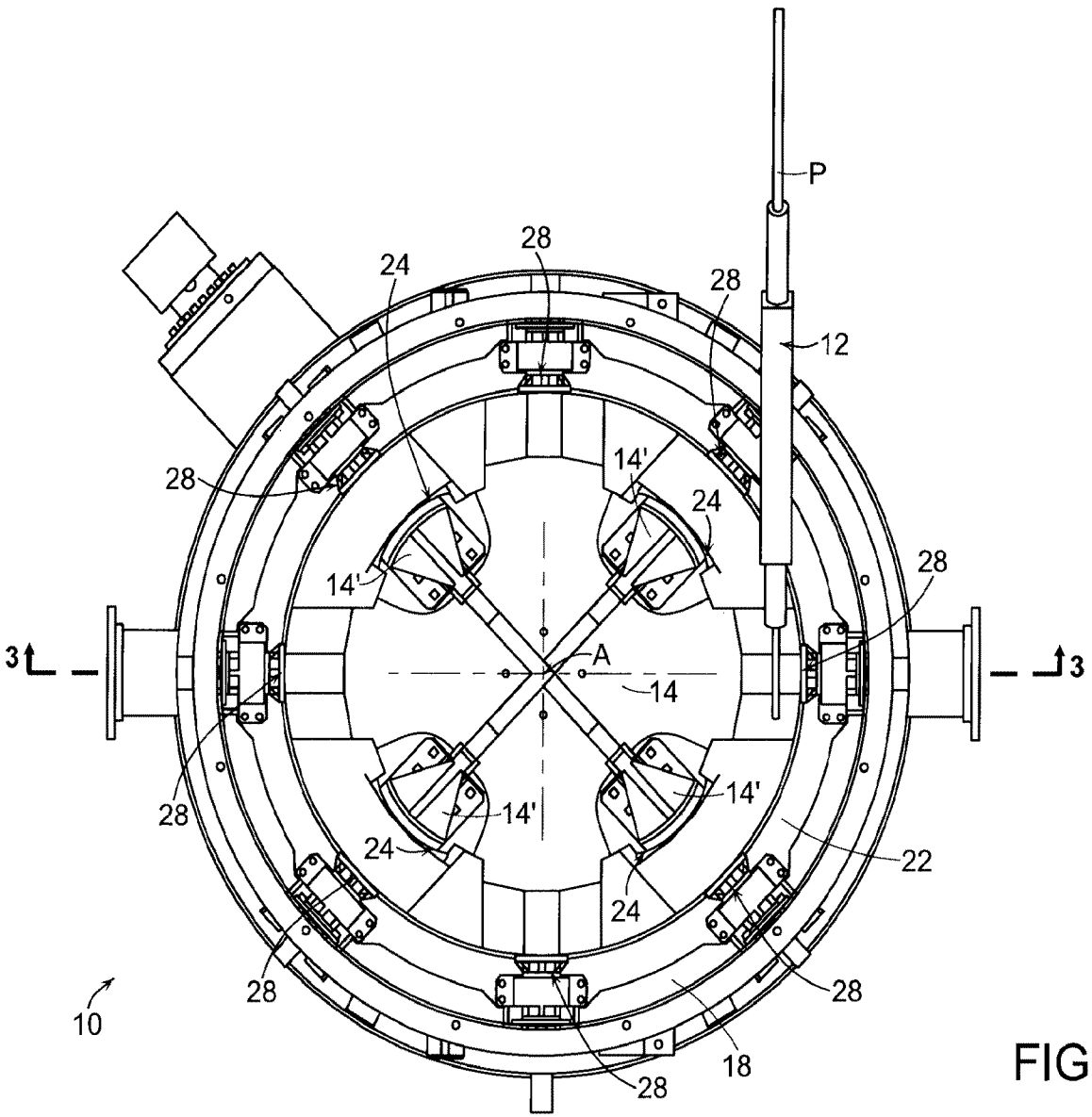
FIG. 2 is an enlarged top plan view of the pouring reel depicted in FIG. 1, showing the pouring reel prior to commencement of a coil forming cycle.
Figure 3:
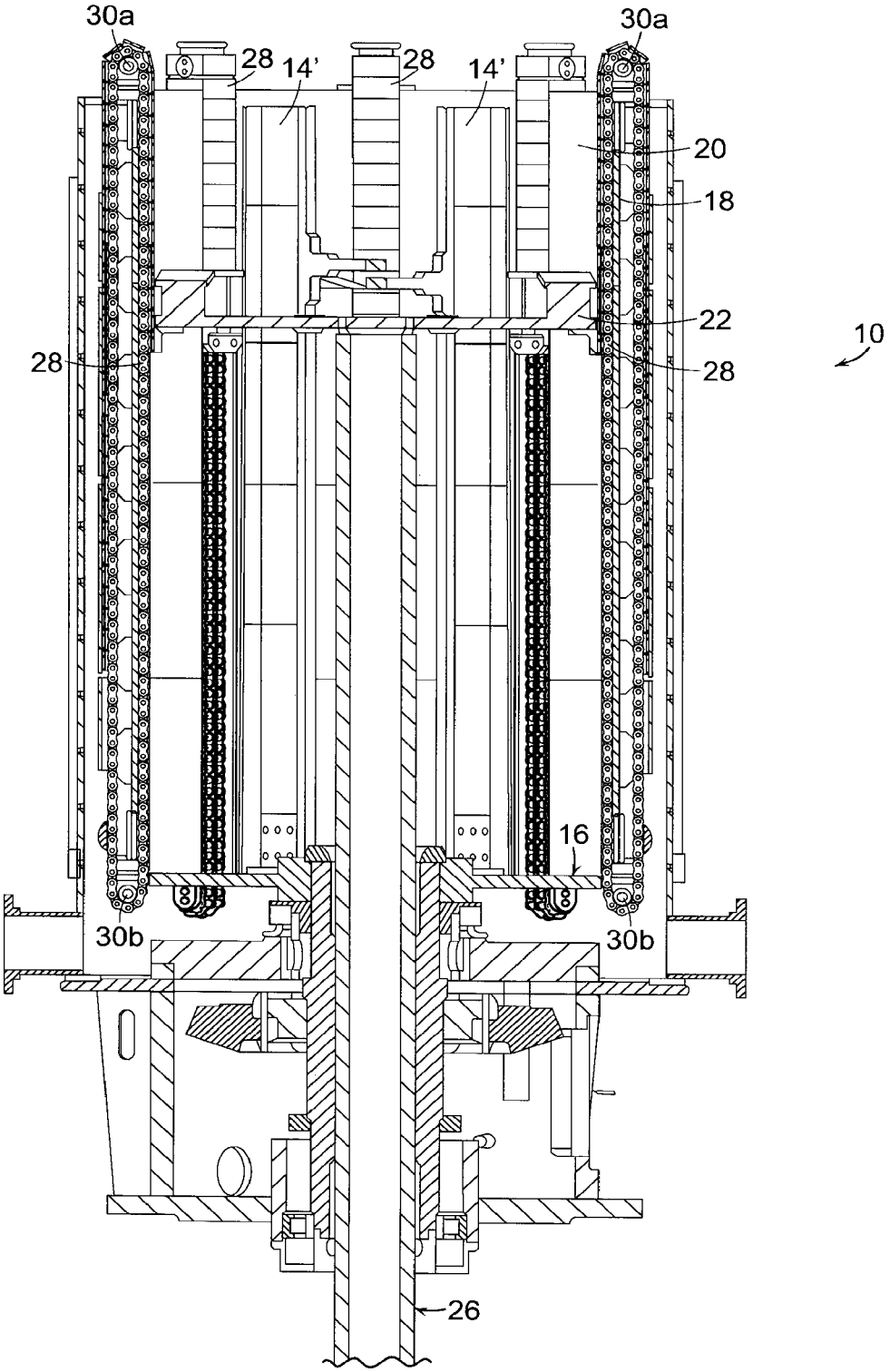
FIG. 3 is a sectional view taken along line 3-3 of FIG. 2.

With reference additionally to FIGS. 2 and 3, it will be seen that the pouring reel comprises a central mast 14 lying on a vertical axis "A" and defined by circumferentially spaced posts 14' projecting vertically from a base 16.

A cylindrical tub 18 projects upwardly from the outer edge of base 16. The tub surrounds and cooperates with the mast 14 to form an annular chamber 20. A coil plate 22 defines a bottom of the annular chamber. As can be best seen in FIG. 2, the coil plate 22 has notches 24 through which the posts 14' project, thereby rotationally coupling the coil plate to the central mast.

The central mast 14, cylindrical tub 18 and coil plate 22, together with the base 16, are rotatable in unison about the vertical axis A. Typically, such rotation will be at a synchronous velocity to that of the product entering the pouring reel, with the nozzle 12 being inclined as shown in FIG. 1 at an angle $\alpha$ with respect to the horizontal, and with its delivery end positioned to direct the product downwardly into the annular chamber 20 for accumulation on the coil plate as a series of superimposed rings.

In addition to being rotatable, the coil plate 22, is vertically adjustable along axis A and relative to the central mast 14 and cylindrical tub 18. Such vertical adjustment may be achieved by an axially reciprocal central shaft 26. During a coil forming cycle, the coil plate 22 is gradually lowered to accommodate the increasing height of a coil being formed in chamber 20, while also maintaining a substantially constant distance between the delivery end of the nozzle 12 and the top of the growing coil.

Figure 6:
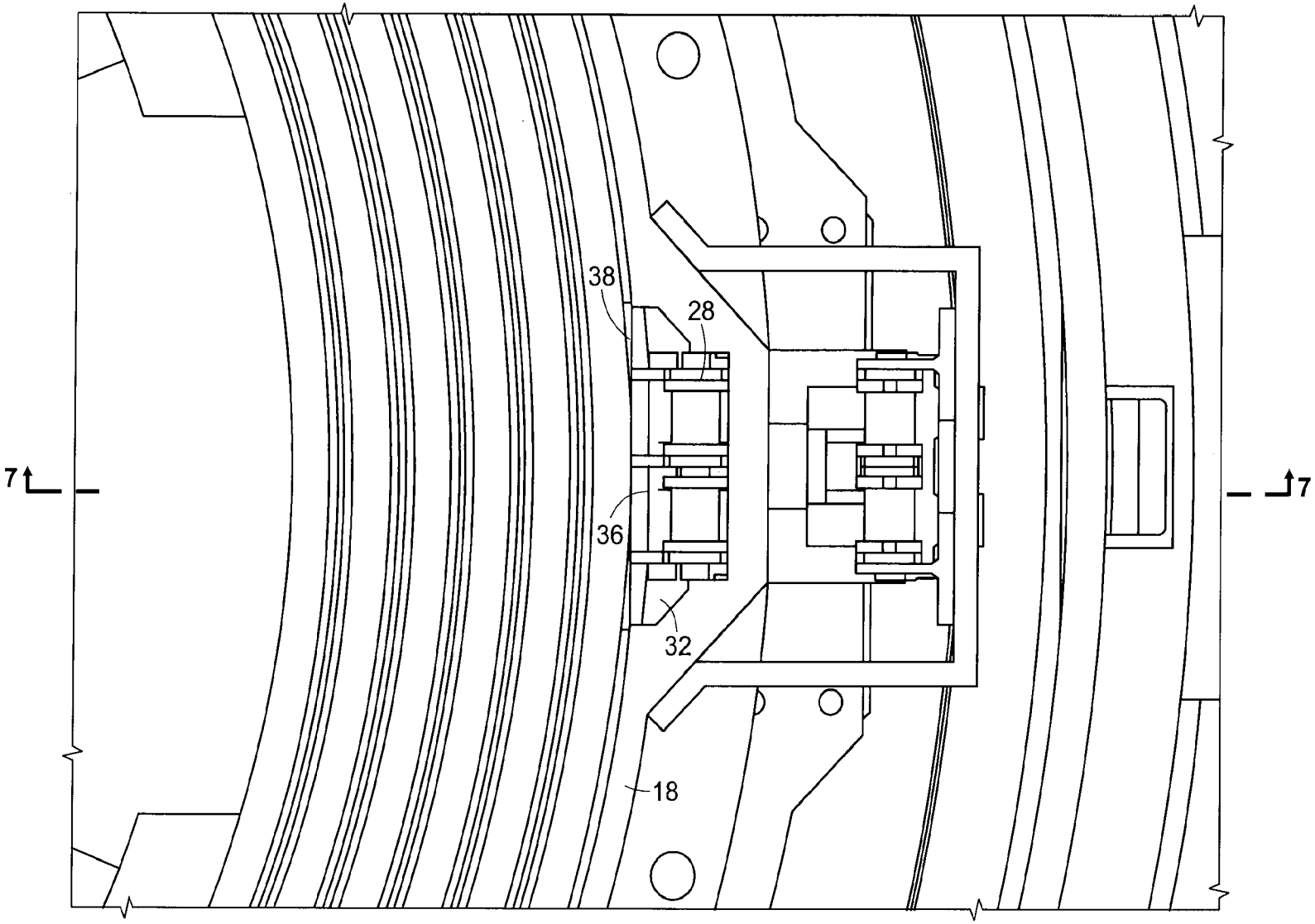
FIG. 6 is an enlarged partial sectional view taken along line 6-6 of FIG. 4.
Figure 7:
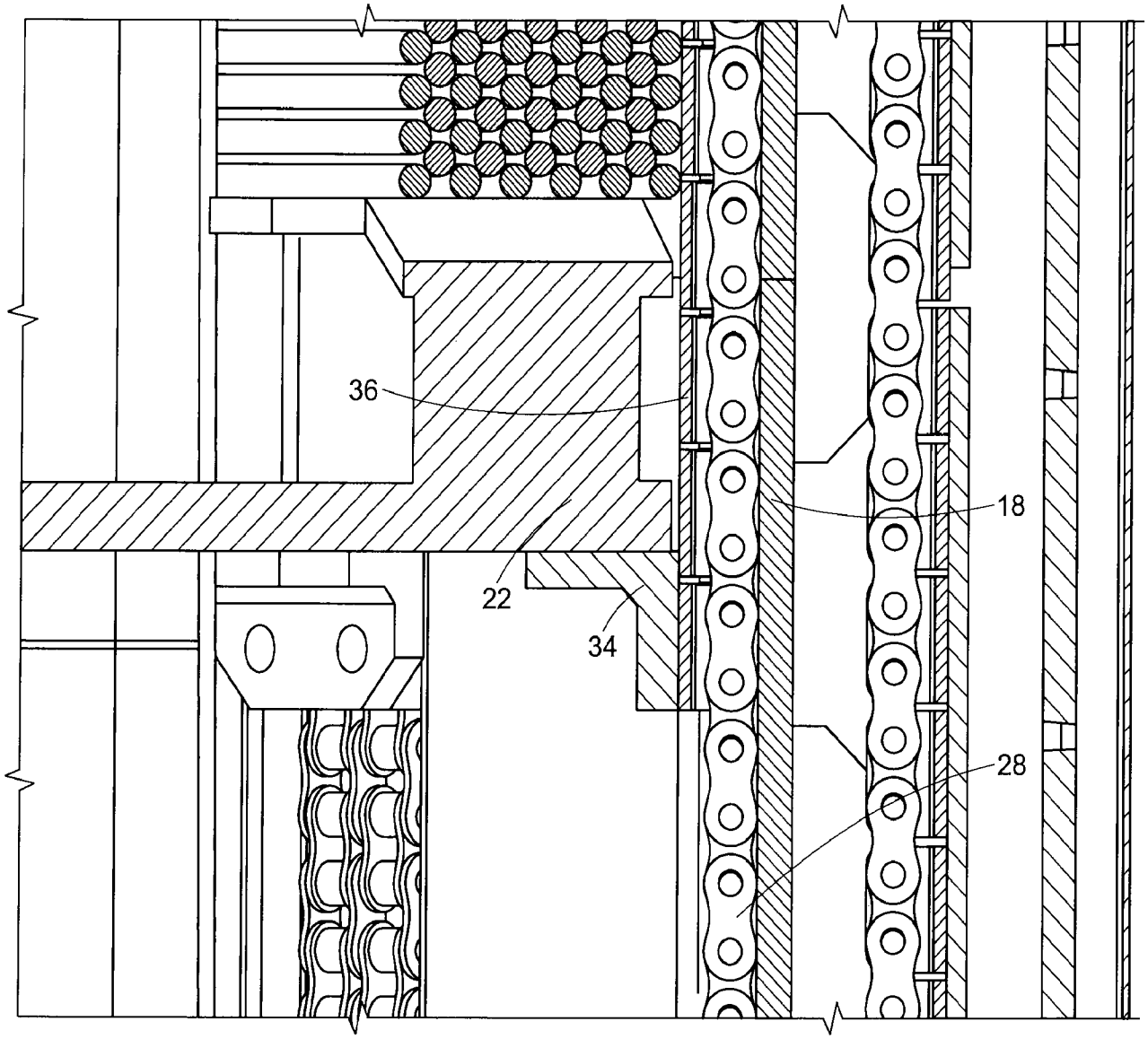
FIG. 7 is a sectional view taken along line 7-7 of FIG. 6.

Vertically traversable conveying elements 28 are circumferentially spaced around the interior surface of the cylindrical tub. With reference to FIGS. 6 and 7, the conveying elements may comprise the inner runs of chain conveyors. The chain conveyor may be of the endless type running vertically between upper and lower sprockets 30*a*, 30*b*. The inner runs of the chain conveyors which serve as the conveying elements 28 may be received in and traversable along guide channels 32 in the interior surface of the tub 18, and may be coupled as at 34 to the coil plate 22. The outer return runs of the chain conveyors extend vertically along the exterior surface of the tub 18.

The inner conveyor runs serving as the conveying elements may include face plates 36 that project radially inwardly as at 38 from the interior surface of the tub 16, and are thus positioned to be contacted by the entering product being urged radially outwardly by centripetal forces.

As the coil forms, the coil plate will descend at the correct rate selected to prevent the coil from spilling out of the top of the tub 18. The rate of descent will vary depending on product size and the delivery speed of the rolling mill.

The centripetal forces that might otherwise prevent the coil from forming uniformly from the fixed bottom of a conventional pouring reel tub are now employed advantageously. If and when the product is subjected to high centripetal forces when handling products at delivery speeds exceeding about 16 m/sec, the vertically traversable conveying elements 28 connected to the coil plate 22 will move the product in contact therewith in the correct direction allowing the next ring to be formed in an orderly manner.

Controlling the rate of coil plate descent controls coil formation. If a tight dense coil is required, the coil plate and conveying elements are moved downwardly at a slower rate. On the other hand, if a more open coil is required, the rate of descent can be increased, thus potentially leaving a small gap between each subsequent ring formed against the descending liner elements.

Figure 4:
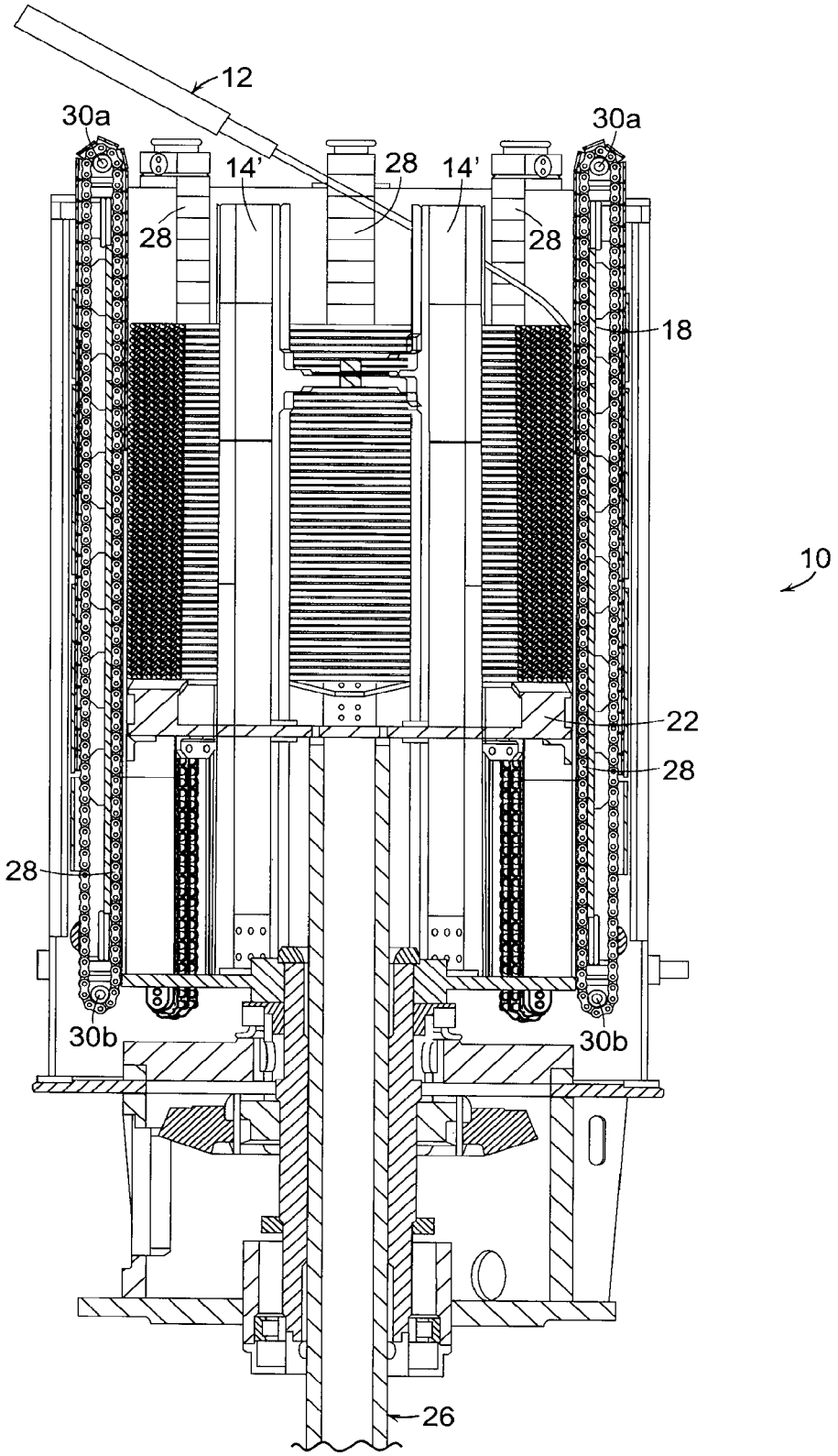
FIG. 4 is a sectional view similar to FIG. 3 showing the pouring reel during a coil forming cycle.
Figure 5:
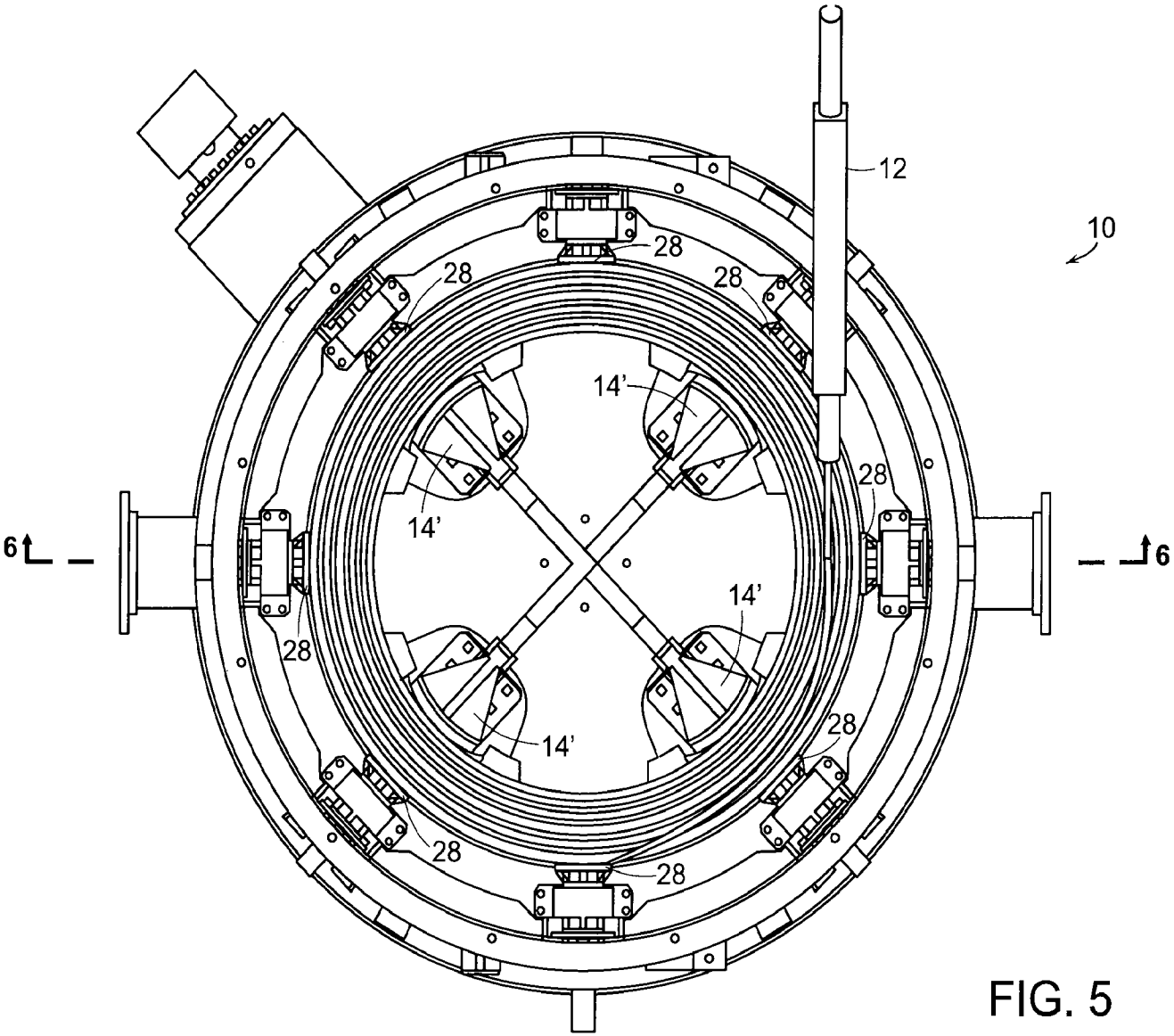
FIG. 5 is a top plan view of the pouring reel as depicted in FIG. 4.

FIGS. 4 and 5 shown the pouring reel during a coil forming cycle, with the coil plate 22 descending towards the base 16.

Figure 8:
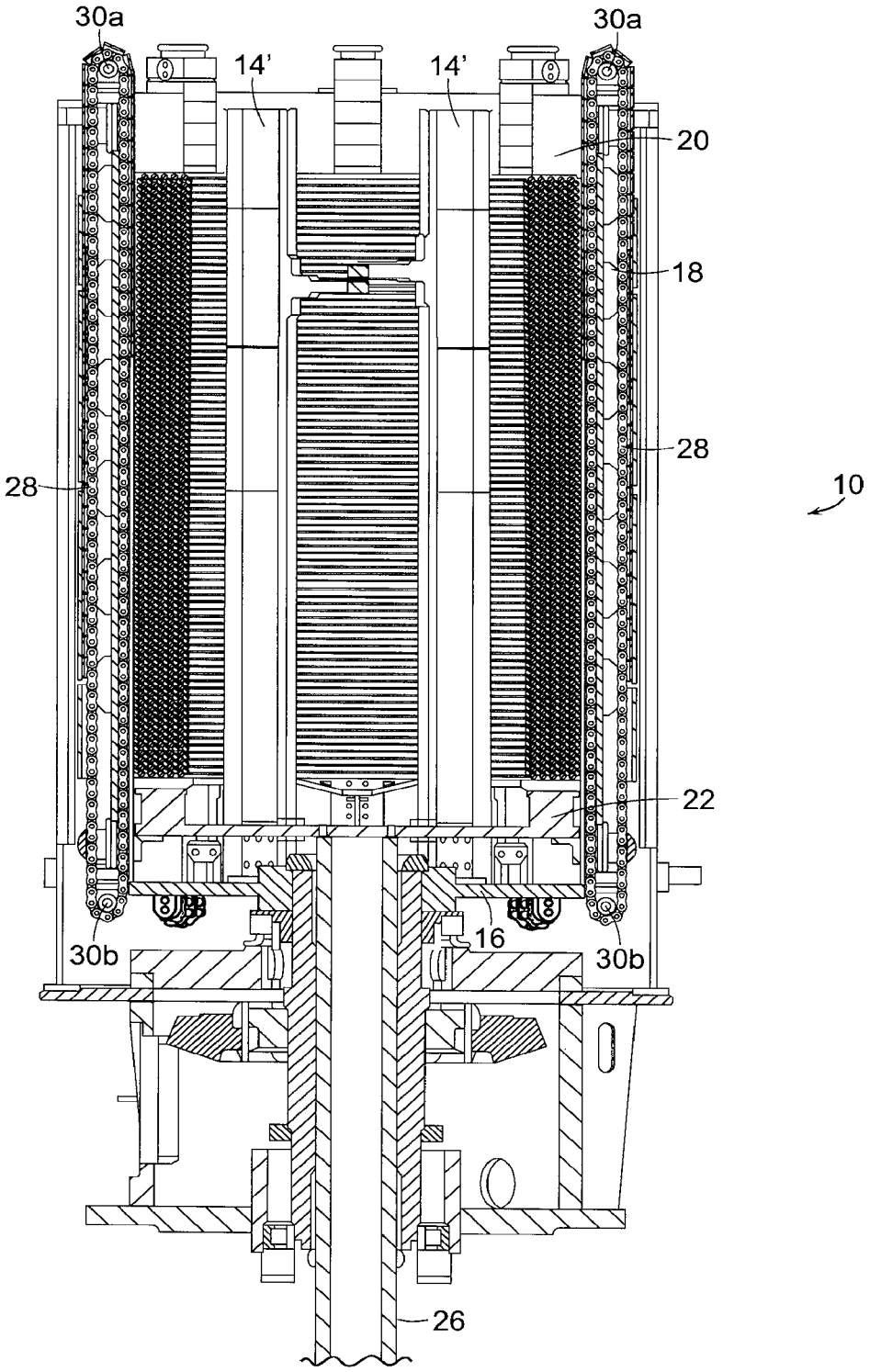
FIG. 8 is a sectional view similar to FIG. 4 showing the pouring reel at the completion of a coil forming cycle.
Figure 9:
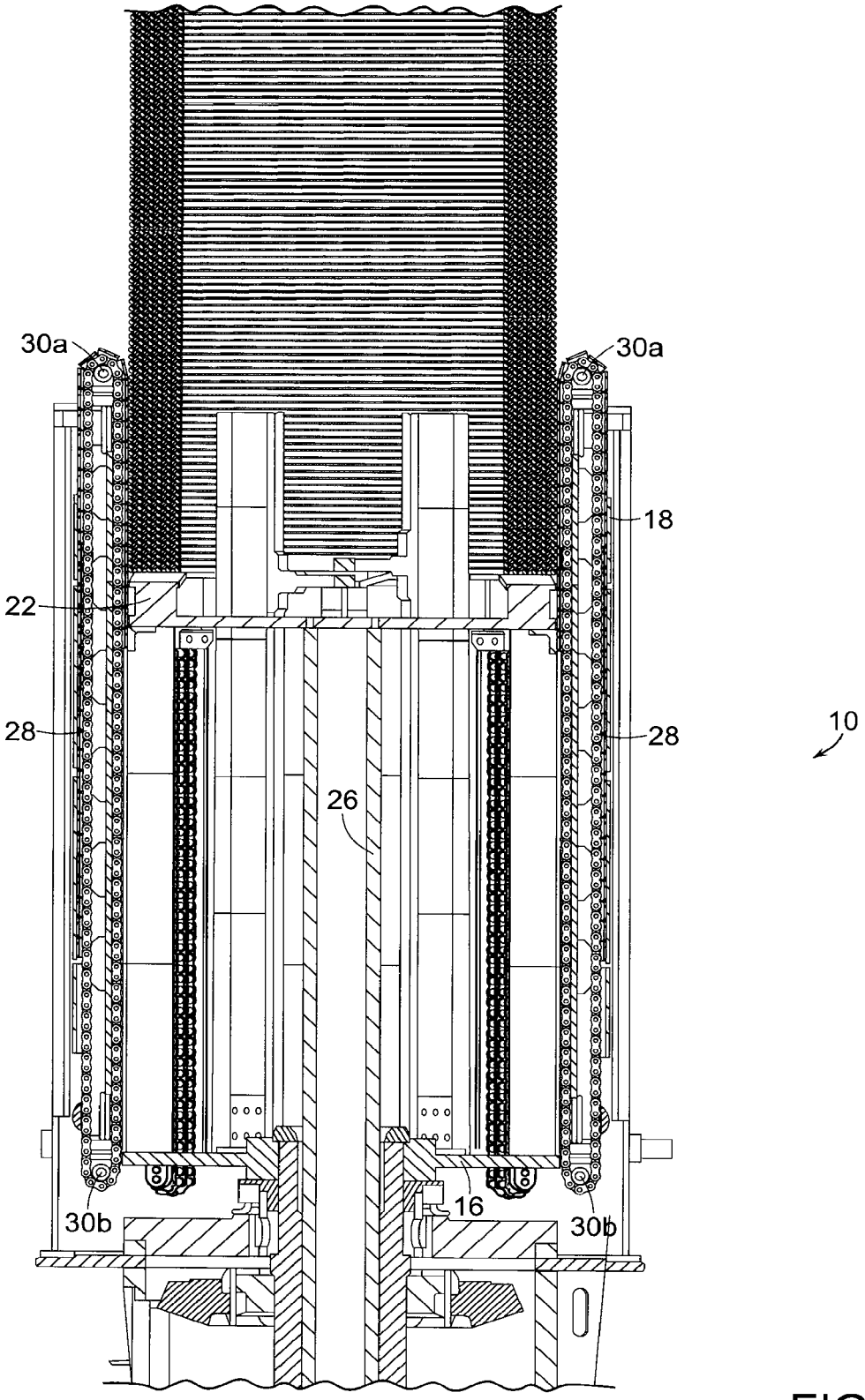
FIG. 9 is a sectional view showing the pouring reel with the coil plate adjusted to its uppermost level to raise the completed coil vertically to an elevated position in readiness for removal from the pouring reel.

FIG. 8 shows the pouring reel at the completion of a coil forming cycle. In FIG. 9, the coil plate has been adjusted to its uppermost level, which projects the completed coil vertically from the tub 18 in readiness for its removal from the pouring reel.

What is claimed is:

1. A pouring reel for forming a hot rolled long product into an annular coil, comprising:

a central mast lying on a vertical axis;

a cylindrical tub surrounding and cooperating with said mast to form an annular chamber;

a coil plate defining a bottom of said chamber;

said central mast, cylindrical tub and coil plate being rotatable in unison about said vertical axis;

an entry nozzle having a delivery end arranged to direct said product downwardly into said chamber for accumulation on said coil plate as a series of superimposed rings forming said coil;

said coil plate being movable downwardly along said axis and relative to said central mast and said cylindrical tub to accommodate the increasing height of the coil being formed in said chamber; and vertically extending conveying elements circumferentially spaced around an interior surface of said cylindrical tub, said conveying elements being traversable downwardly and synchronously with said coil plate.

2. The pouring reel of claim 1 wherein said vertically traversable conveying elements are coupled to said coil plate.

3. The pouring reel of claim 2 wherein the conveying elements comprises endless conveyor chains or belts that extend between upper and lower idlers carried by said cylindrical tub.

4. The pouring reel of claim 3 wherein said conveyor chains or belts have outer return runs extending vertically along the exterior surface of said cylindrical tub.

5. The pouring reel of claim 3 wherein inner runs of said conveyor chains or belts are received in and are traversable along guide channels in the interior surface of said cylindrical tub.

6. The pouring reel of claim 5 wherein the inner runs of said conveyor chains or belts project radially inwardly from the interior surfaces of said cylindrical tub.

7. The pouring reel of claim 1 wherein said coil plate is moveable downwardly to maintain a substantially constant distance between the delivery end of said nozzle and the top of the coil being formed in said annular chamber.

8. The pouring reel of claim 1, wherein said entry nozzle is arranged at an angle of between 25° and 35° with respect to the horizontal.

9. The pouring reel of claim 8 wherein said angle is 30°.

10. A pouring reel for forming a hot rolled long product into an annular coil, comprising:

a central mast lying on a vertical axis;

a cylindrical tub surrounding and cooperating with said mast to form an annular chamber;

a coil plate defining a bottom of said chamber;

said central mast, cylindrical tub and coil plate being rotatable in unison about said vertical axis;

an entry nozzle having a delivery end arranged to direct said product downwardly into said chamber for accumulation on said coil plate as a series of superimposed rings forming said coil;

said coil plate being movable downwardly along said axis and relative to said central mast and said cylindrical tub;

conveyor elements circumferentially spaced around said cylindrical tub, said conveying elements being received in and movable along vertical guide channels in the interior surface of said cylindrical tub, said conveying elements having face plates projecting radially inwardly from an interior surface of said cylindrical tub and being coupled to and driven by the vertical adjustment of said coil plate.

11. A pouring reel for forming a hot rolled long product into an annular coil, comprising:

a central mast lying on a vertical axis;

a cylindrical tub surrounding and cooperating with said mast to form an annular chamber;

a coil plate defining a bottom of said chamber;

said central mast, cylindrical tub and coil plate being rotatable in unison about said vertical axis;

an entry nozzle having a delivery end arranged to direct said product downwardly for accumulation on said coil plate and within said chamber as a series of superimposed rings forming said annular coil, said entry nozzle being inclined at an angle of between 25° and 30° with respect to the horizontal;

said coil plate being adjustable vertically along said axis and relative to said central mast and said cylindrical tub to maintain a substantially constant distance between the delivery end of said nozzle and the top of the coil being formed in said annular chambers; and vertically traversable conveying elements circumferentially spaced around and extending vertically along the interior surface of said cylindrical tub, said conveying elements being coupled to and driven by the vertical adjustment of said coil plate.

* * * * *